United States Patent [19]

Lautenschläger

[11] Patent Number: 4,641,393

[45] Date of Patent: Feb. 10, 1987

[54] CABINET HINGE

[75] Inventor: Horst Lautenschläger, Reinheim, Fed. Rep. of Germany

[73] Assignee: Karl Lautenschlager KG, Mobelbeschlagfabrik, Reinheim, Fed. Rep. of Germany

[21] Appl. No.: 760,764

[22] Filed: Jul. 31, 1985

[30] Foreign Application Priority Data

Aug. 11, 1984 [DE] Fed. Rep. of Germany ..... 3429636

[51] Int. Cl.[4] ..... E05D 7/04

[52] U.S. Cl. ..... 16/241; 16/246; 16/370; 16/282; 403/115; 403/117

[58] Field of Search ..... 16/238, 240, 241, 246, 16/245, 271, 272, 264, 254, 370, 382, DIG. 39–DIG. 41, DIG. 43; 403/114, 115, 116, 117

[56] References Cited

U.S. PATENT DOCUMENTS 3,192,868 7/1965 Wahlmark ..... 403/122 X 4,365,384 12/1982 Vitt ..... 16/371 X 4,515,336 5/1985 Fischer ..... 403/123 X

*Primary Examiner*—James M. Meister

[57] ABSTRACT

The supporting arm of a cabinet hinge is adjustably mounted on a mounting plate to be attached to the supporting wall of a cabinet and has at its cabinet-internal end an open-ended longitudinal slot through which passes a screw fastening it to the mounting plate. A setscrew is threaded in a tap situated adjacent the front or outer end of the supporting arm and has at its bottom end adjacent the mounting plate a holding head in the form of a spherical body having a circumferential annular groove formed in rotational symmetry with the longitudinal axis of the setscrew. The holding head is inserted into an open-ended longitudinal groove having a narrow mouth, the cross section of the groove being substantially complementary to the cross section of the holding head in a plane in the longitudinal axis of the setscrew, so that the holding head is accommodated so as to be longitudinally displaceable in the longitudinal groove but secured against lifting out of the groove.

9 Claims, 12 Drawing Figures

FIG. 1
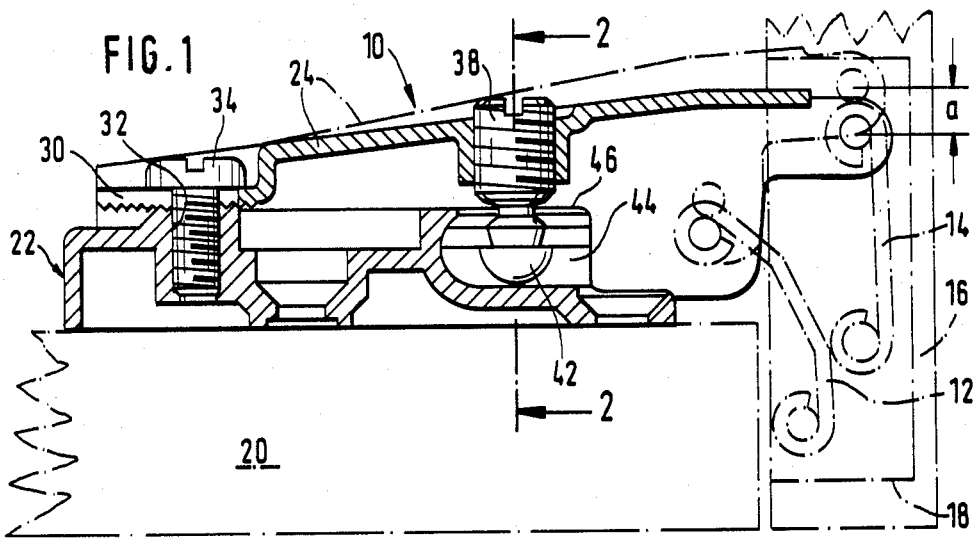
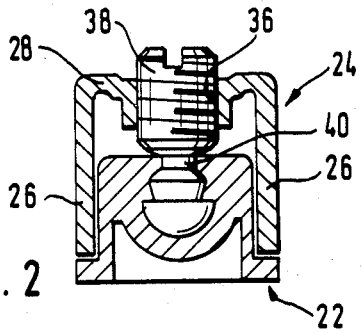
FIG. 2
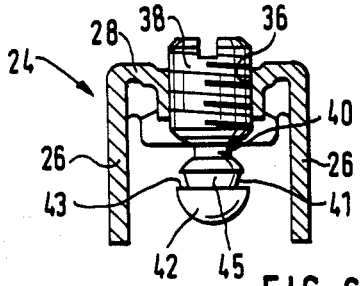
FIG. 6
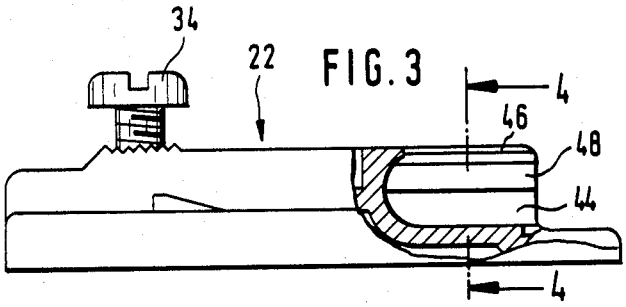
FIG. 3
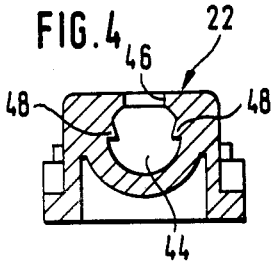
FIG. 4
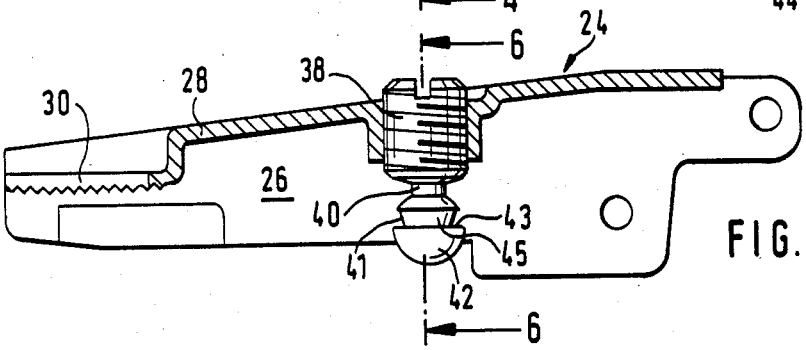
FIG. 5

CABINET HINGE

BACKGROUND OF THE INVENTION

The invention relates to a cabinet hinge whose supporting wall-related part in the form of an elongated supporting arm is mounted on a mounting plate which can be fastened to the supporting wall of a cabinet and is pivotally coupled, through a jointed mechanism, to a door-related hinge part which can be fastened to the door. In hinges of this kind, the supporting arm has in its end portion pointing into the interior of the cabinet case an open-mouthed longitudinal slot through which passes the shaft of a mounting screw driven into the mounting plate; a tap is provided in the front end of the supporting arm pointing out of the cabinet case interior, into which tap a setscrew is threaded, on whose bottom end on the mounting plate side there is provided, on a neck-like portion of reduced diameter, a holding head, defined in part by partially spherical surfaces, and having an increased diameter, which is inserted into a narrowed opening, provided in the mounting plate, of a slot open at the jointed-mechanism end which secures the holding head against lifting away.

Cabinet hinges having a supporting wall-related part which is made adjustable by a circular disk-like holding head in this manner are known (DE-OS No. 26 14 447), and their use is increasing on account of the possibility which they provide for the relatively quick and simple hanging of a door equipped with such hinges on the corresponding supporting wall of the cabinet case. These hinges have been further developed by the applicant by modifying the holding head from a circular disk-like configuration to a substantially full sphere so that they allow a still greater length for adjustment for the door overlap (DE-OS No. 33 02 312). Mounting plates pertaining to these known hinges have heretofore been made exclusively from die-cast metal, namely from zinc alloy (Zamak), and thus, in comparison with the simpler mounting plates made by stamping from sheet metal used in other hinge types, they are relatively expensive, because, due to the lower strength of the alloy, the walls of the mounting plates made from zinc die-casting metal must be made decidedly thicker than in the case of mounting plates pressed from sheet steel, and the result is a comparatively greater weight, i.e., a greater consumption of the zinc die-casting alloys which are comparatively expensive in themselves.

The invention is addressed to the problem of further developing the known hinge described in the beginning such that it will be usable both in conjunction with mounting plates of zinc die-casting alloy and with mounting plates made by stamping, because of improved strength in the area of the engagement of the holding head in the corresponding slot in the mounting plate. Moreover, the supporting arm of the new hinge is to be usable without modification or alteration on the mounting plates of hinges of the former kind in which the holding head on the setscrew for the adjustment of the door overlap is made in the form of a sphere.

Setting out from a hinge of the kind described in the beginning, this problem is solved in accordance with the invention in that the holding head has the form of a body developed from a sphere having an annular circumferential groove formed in rotational symmetry with the longitudinal central axis of the setscrew. The modified holding head is therefore developed from the spherical holding head in such a manner that it fits the known mounting plates designed for hinges with a spherical holding head. Furthermore, the annular circumferential groove additionally provided in the holding head also permits the further development of the mounting plates in the longitudinal slot area such that additional form-fitting engagement is achieved between the holding head and the longitudinal slot and thus increased strength.

In a preferred further development of the invention, the circumferential groove has a triangular cross section with the apex of the triangle pointing toward the longitudinal axis of the setscrew. At the same time the circumferential groove is preferably formed in the half of the holding body which adjoins the neck portion, i.e., the bottom half of the holding head still has the shape of a hemisphere.

The annular surface defining the neck side of the substantially hemispherical surface of the holding body lies, however, preferably in a plane passing through the spherical center of the holding body at right angles to the longitudinal central axis of the setscrew.

Alternatively, the circumferential groove can also have a substantially trapezoidal cross section expanding from the inside out, in which case it is then recommendable to provide it approximately in the equatorial area of the holding body.

If the hinge of the invention is to be used together with a mounting plate made of metal by die casting, the configuration is made such, in accordance with the invention, that the slot in the mounting plate has underneath its narrowed opening a cross section which is substantially complementary to the cross-sectional surface of the holding head in a section plane passing through the longitudinal central axis of the setscrew.

If the supporting arm of the hinge of the invention is, on the other hand, to be fastened on a mounting plate made by stamping from sheet metal, the configuration of the mounting plate is best made such that the slot provided in it to receive the holding head is formed by a longitudinal slot, open at the end pointing toward the jointed mechanism, in its wall that is covered by the supporting arm, this wall's width being approximately equal to or only slightly greater than the diameter of the neck portion joining the setscrew to the holding head. The form-fitting holding of the setscrew to the mounting plate is therefore provided in the area of the neck portion, while the securing of the supporting arm against lifting away from the mounting plate is provided by the holding head reaching under the longitudinal slot, and the securing against the opposite movement, i.e., toward the mounting plate, is provided by the face of the setscrew itself projecting radially beyond the neck portion.

The length of the neck portion is preferably slightly smaller than the thickness of the metal at the edges of the mounting plate defining the longitudinal slot, the edges of the longitudinal slot being then chamfered at their underside facing the holding head such that the chamfer is, in cross section, approximately tangential to the portion of the holding head adjoining the neck portion. This prevents the danger of damage to the holding head in the area of engagement with the bottom arris of the longitudinal slot or of the rapid wear of this arris, which would be the case if the arris were to be made simply sharp.

BRIEF SUMMARY OF THE DRAWINGS

The invention will be further explained in the description that follows of several embodiments, in conjunction with the drawings wherein:

FIG. 1 is a longitudinal central section through a cabinet hinge constructed in the manner of the invention, FIG. 2 is a cross-sectional view seen in the direction of the arrow 2—2 in FIG. 1, FIG. 3 is a partially cut-away side view of the mounting plate of the hinge shown in FIGS. 1 and 2, FIG. 4 is a section seen in the direction of the arrows 4—4 of FIG. 3, FIG. 5 is a longitudinal central section through the supporting arm of the hinge shown in FIGS. 1 and 2, FIG. 6 is a cross section seen in the direction of the arrows 6—6 of FIG. 5.

DESCRIPTION OF PREFERRED EMBODIMENTS

Figure 7:
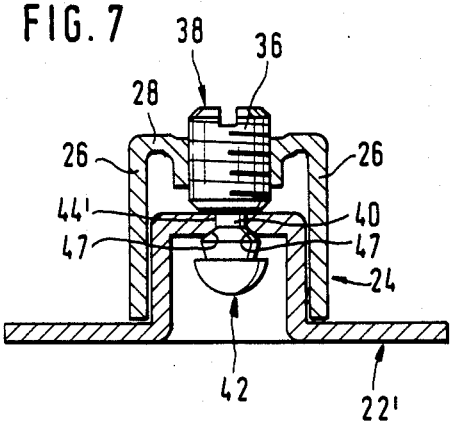
FIG. 7 is a cross section corresponding to the one in FIG. 2 through a modified embodiment of a cabinet hinge of the invention.
Figure 12:
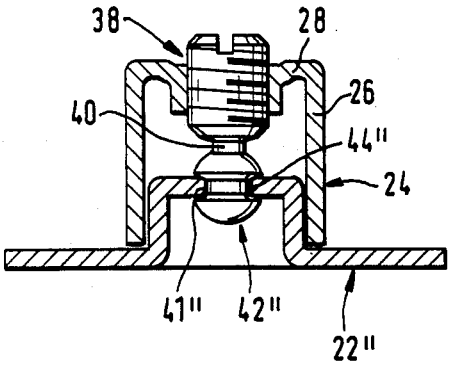
FIG. 12 is a cross-sectional view corresponding to FIGS. 2 and 7 through an other embodiment of the cabinet hinge, in which the hinge supporting arm is held by means of a setscrew of FIG. 10 on a mounting plate made from sheet steel.

The hinge in accordance with the invention shown in FIGS. 1 and 2 and designated as a whole by the numeral 10 is composed of two hinge parts pivotally coupled together by hinge links 12 and 14 in the manner of a four-joint system, namely the door-related hinge part in the form of an insert cup 18 which is recessed into a mortise in the back of a door 16, and the supporting wall-related hinge part in the form of an elongated supporting arm 24 adjustably mounted on a mounting plate 22 fastened to the supporting wall 20 of the cabinet. The hinge links 12 and 14 and the cup 18 of the hinge 10 are, like the door 16 and the supporting wall 20 of the cabinet, indicated but diagrammatically by broken lines in FIG. 1 so as not to interfere with comprehension of the idea of the invention, which lies in the nature of the adjustable fastening of the supporting arm 24 on the mounting plate 22.

The supporting arm 24 of the hinge 10 (see also FIGS. 5 and 6) is channel-shaped, and has in the end portion remote from the door, i.e., inside of the cabinet case, of its back 28 joining the sides 26 of the channel, a longitudinal slot 30 open at the rearward end, through which passes the shaft of a mounting screw 34 driven into the mounting plate 22. At a distance in the direction of the front end, or door end, of the supporting arm 24 there is provided in the back 28 of the arm a tap 36 into which a setscrew 38 is threaded, at whose bottom end facing the mounting plate 22 a holding head 42 is integrally formed on a short neck portion 40 of reduced diameter. The holding head 42 has the form of an originally spherical body in which a circumferential annular groove 41 of triangular cross section with inwardly pointing apex is formed in rotational symmetry with the longitudinal central axis of the setscrew. This annular groove is defined by a planar, radial, annular surface 43 sharply separating the bottom hemispherical half of the holding head 42 from the upper half, and a surface of annular configuration 45 flaring conically from the inner edge of the annular surface 43 and merging at its upper end with the remaining segment of the sphere of the holding head (FIG. 6).

The mounting plate 22 (FIGS. 3 and 4) is provided, in the area beneath the tap 36, with a longitudinal groove 44 open at its front end facing the door and having a narrow slot opening 46 whose width is approximately equal to or only slightly greater than the diameter of the neck portion 40 of the setscrew 38.

In the area beneath the slot opening 46, the longitudinal groove 44 has a cross section corresponding to the cross-section of the holding head 42, i.e., longitudinal ribs 48 of triangular cross section (FIGS. 3 and 4) project from opposite sides of the wall of the basically arcuately defined longitudinal groove 44 and matingly engage the circumferential annular groove 41.

It is now apparent that the mounting of the supporting arm 24 on the mounting plate 22 is accomplished simply by pushing it, with the fastening screw 34 loosened, parallel to the supporting wall 20 with its rearward longitudinal slot 30 under the head of the fastening screw 34, while the holding head 42 enters into the open end of the longitudinal groove 44. Within the area defined by the length of the longitudinal slot 30 and of the longitudinal groove 44, the supporting arm 24 can then be displaced longitudinally, parallel to the surface of the supporting wall 20. The supporting arm 24 can then be clamped on the mounting plate 22 by tightening the fastening screw 34. By turning the set screw 38, the supporting arm, on the other hand, can be raised or lowered on the set screw 38 relative to the mounting plate 22, so that, for example, it can be shifted from the position represented in solid lines in FIG. 1 into the position differing therefrom by the amount a and represented in broken lines. Then, however, the overlap of the door 16 on the front edge of the supporting wall 20 is adjusted by a corresponding amount.

FIG. 7 shows the mounting of a supporting arm corresponding to the supporting arm 24 described in conjunction with FIGS. 1 to 6 on a modified mounting plate 22′ made in this case by stamping from sheet steel. Instead of the longitudinal groove 44 in the mounting plate 24, in the case of the mounting plate 22′, a longitudinal slot 44′ open at the front, i.e., at the joint mechanism end, is provided in the raised portion of the mounting plate which is straddled by the supporting arm 24. The width of this longitudinal slot 44′ is slightly greater than the diameter of the neck portion 40 of the setscrew 38. On the other hand, the length of the neck portion is nevertheless slightly shorter than the thickness of the material of the sections of the raised portion of the mounting plate laterally defining the longitudinal slot 44′. In order nevertheless to be able to introduce the neck portion 40 into the longitudinal slot 44′, the longitudinal margins of the latter are chamfered at 47 on the bottom facing the holding head 42, this chamfer 47 being able to be produced by designing the stamping die accordingly, i.e., no complex, separate cutting operation is required. Instead, when the chamfer 47 is made by stamping, the material in this area is further hardened, thereby improving the stress-withstanding properties of the junction between the holding head 42 and the margins of the longitudinal slot 44'. It is thus apparent, however, that the supporting arm can be used without modifying the setscrew 38, both with mounting plates made by the zinc alloy die-casting process and with the mounting plates made by stamping from sheet metal.

Figure 8:
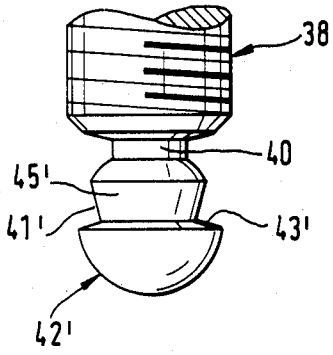
FIG. 8 is a side view of the lower end, bearing the holding head, of a setscrew for varying the setting of the overlap of a door in a configuration differing from the embodiment shown in FIGS. 1 and 2.
Figure 9:
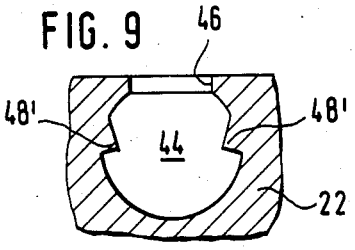
FIG. 9 is a cross section through the longitudinal slot in a mounting plate, which is intended for the accommodation of the holding head of FIG. 8.

In FIGS. 8 and 9 there is shown still another configuration of a holding head 42' and of the correspondingly modified longitudinal groove 44, which differs slightly from the holding head 42 of the setscrew 38. The difference from the above-described embodiment is that the planar radial annular surface 43 of holding head 42 is, in the case of holding head 42', an annular surface 43' configured in the form of a short, truncated cone. The bottom surfaces of the longitudinal ribs 48' in the longitudinal groove 44 which are associated with the annular surface 43' when the holding head 42' engages the longitudinal groove 44 in the corresponding mounting plate 22 therefore do not lie in one plane, but are at an angle to one another corresponding to the cone angle of the annular surface 43'.

Figure 10:
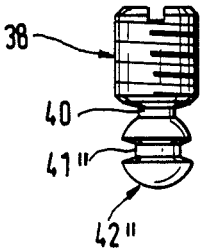
FIG. 10 is an additional embodiment of a setscrew with a modified holding head.
Figure 11:
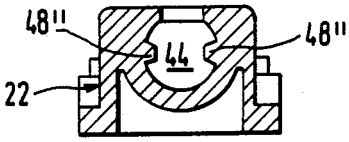
FIG. 11 is a cross sectional view corresponding to that of FIG. 4, through a mounting plate for holding a hinge supporting arm provided with a setscrew of FIG. 10.

Another possible modification of the holding head 42'' on the setscrew 38 for the overlap adjustment of the supporting arm, and of the corresponding longitudinal groove 44 in mounting plate 22 is represented in FIGS. 10 and 11. The circumferential annular groove is in this case a groove 41'' of trapezoidal cross section flaring outwardly approximately in the equatorial area of the holding head 42''. The longitudinal ribs 48'' projecting from the wall of the longitudinal groove 44 of the mounting plate 22 and engaging the annular groove 41'' accordingly have a complementary trapezoidal cross section.

The fastening of this holding head 42'' in a mounting plate made by stamping from steel can be accomplished either like that of holding head 42 shown in FIG. 7, i.e., the neck portion 40 is inserted into the longitudinal slot 44' of the mounting plate 22'. Alternatively, however, the method of fastening to a modified mounting plate 22'' is also possible. The mounting plate 22'' differs from the mounting plate 22' in that its longitudinal slot 44'' is provided not at the level of the neck portion 40, as in the case of mounting plate 22', but at the level of the longitudinal ribs 48'' of the mounting plate 22 shown in FIG. 11. That is to say, the marginal areas of the raised portion of the mounting plate 22'' laterally defining the longitudinal slot 44'' engage the circumferential annular groove 41'' of the holding head 42'' of the setscrew 38 in accordance with FIG. 10.

It is apparent that modifications and improvements in the embodiments described can be made within the scope of the concept of the invention. In particular, the circumferential groove additionally provided in the holding head 42, which is to be thought of as originally spherical, can have a shape differing from the above-described triangular or trapezoidal cross-sectional shape, for example a wholly or partially arcuate cross section.

We claim:

1. A hinge comprising: an elongated mounting plate to be fastened to a supporting wall of a piece of furniture, and an elongated supporting arm mounted for longitudinal adjustment on said mounting plate, said supporting arm having a first longitudinal end area with an open-ended first longitudinal slot, a mounting screw screwed into said mounting plate and having a shaft passing through said first slot, said supporting arm having a second end area with a tap therethrough, said mounting plate having an open-ended second longitudinal slot at an end area adjacent said tap, a setscrew screwed into said tap and having connected thereto a neck portion of reduced diameter and holding means below said neck portion in said second slot, said holding means being a sphere having a circumferential annular groove formed in rotational symmetry with respect to the longitudinal central axis of said setscrew, said second slot having a narrow longitudinal mouth securing said holding means from being lifted out of said second slot towards said supporting arm.

2. A hinge according to claim 1, wherein the circumferential groove has a triangular cross section with an apex pointing at the longitudinal central axis of the setscrew.

3. A hinge according to claim 2, wherein the circumferential groove is formed in the half of the holding means that adjoins the neck portion.

4. A hinge according to claim 3, wherein the circumferential groove forms an annular surface defining the neck-portion side of a substantially hemispherical half of the holding means remote from the neck portion and lies substantially in a radial plane passing through the spherical center of the holding means at right angles to the setscrew longitudinal central axis.

5. A hinge according to claim 1, wherein the circumferential groove has a substantially trapezoidal cross section flaring from the inside out.

6. A hinge according to claim 4, wherein the circumferential groove is provided approximately in the equatorial area of the holding means.

7. A hinge according to claim 1, wherein said mounting plate is a die-cast metal mounting plate, and wherein the second slot in the mounting plate has underneath its narrow mouth a cross section which corresponds in a substantially complementary manner to the cross-sectional surface of the holding means in a section plane laid through the setscrew longitudinal central axis.

8. A hinge according to claim 1, wherein said mounting plate is a stamped and pressed sheet metal mounting plate, and wherein the second slot in the mounting plate for the accommodation of the holding means is formed in a raised portion of the mounting plate straddled by the supporting arm, the width of the second slot being approximately equal to or slightly greater than the diameter of the neck portion.

9. A hinge according to claim 8, wherein the length of the neck portion is smaller than the thickness of margins of the mounting plate defining the second slot, and margins of the second slot having a chamfer at a bottom thereof facing said holding means such that the chamfer is approximately tangential in cross section to the portion of the holding means adjoining the neck portion.

* * * * *